US006640573B1

(12) United States Patent
Lee

(10) Patent No.: US 6,640,573 B1
(45) Date of Patent: Nov. 4, 2003

(54) COMBINATION STRUCTURE OF GUIDE RAIL MEMBER FOR KIMCHI STORAGE DEVICE

(75) Inventor: Young-Gil Lee, Asan-shi (KR)

(73) Assignee: Mando Climate Control Corporation (KR)

( * ) Notice: Subject to any disclaimer, the term of this patent is extended or adjusted under 35 U.S.C. 154(b) by 0 days.

(21) Appl. No.: 10/175,263

(22) Filed: Jun. 19, 2002

(51) Int. Cl.[7] ..... F25D 23/02; A47B 88/00

(52) U.S. Cl. ..... 62/266; 62/382; 312/334.5; 312/334.1

(58) Field of Search ..... 62/266, 382, 378, 62/265; 165/263; 312/334.1, 334.5, 334.6, 334.23

(56) References Cited

U.S. PATENT DOCUMENTS 5,947,197 A 9/1999 Lee et al.
5,988,780 A 11/1999 Rock et al.
6,253,668 B1 7/2001 Lee

*Primary Examiner*—Chen Wen Jiang
(74) *Attorney, Agent, or Firm*—Fish & Richardson P.C.

(57) ABSTRACT

Disclosed is combination structure of a guide rail member for a kimchi storage device which includes guide grooves for guiding guide rail members formed at both lower sides of a drawer-type inner case for storage of vegetables, a hooking protrusion elongated from one side of the guide groove, and a fixing member for screwing an upper end of the hooking protrusion to maintain a certain space between a lower end of the hooking protrusion and the guide groove, in which one side of a lower end of the fixing member is integrated to one side of the guide rail member so that the inner case integrated to the guide rail member may be smoothly opened and closed though the inner case is partially deformed due to the pressure of insulating materials put outside the inner case.

3 Claims, 4 Drawing Sheets

COMBINATION STRUCTURE OF GUIDE RAIL MEMBER FOR KIMCHI STORAGE DEVICE

BACKGROUND OF THE INVENTION

1. Field of the Invention

The present invention relates to a kimchi storage device, and more particularly to a combination structure of a guide rail member for a kimchi storage device which includes guide grooves for guiding guide rail members formed at both lower sides of a drawer-type inner case for storage of vegetables, a hooking protrusion elongated from one side of the guide groove, and a fixing member for screwing an upper end of the hooking protrusion in order to maintain a certain space between a lower end of the fixing member and the guide groove, in which one side of a lower end of the fixing member is integrated to one side of the guide rail member so that the inner case integrated to the guide rail member may be smoothly opened and closed even though the inner case is partially deformed due to the pressure of insulating materials supplied outside the inner case.

2. Description of the Related Art

In general, a refrigerator is a kind of cooling apparatus. The refrigerants are condensed and liquefied under high pressure by using a condenser. The condensed refrigerants are transported to an expansion valve having a tube of a small diameter. Here, the refrigerants are instantaneously vaporized in an evaporator, and thus a temperature is lowered to generate cooling air. The cooling air is supplied to a main body of the refrigerator, thus maintaining freshness of foods in the refrigerator.

The refrigerant vaporized in the evaporator by absorbing heat is transported from a compressor to a condenser, and is condensed and liquefied in the condenser, thereby discharging heat. Thereafter, the above-described procedure is repeated to continuously perform the cooling operation.

On the other hand, a kimchi storage device using the refrigeratation principle to ripen kimchi and maintain freshness of kimchi has been popularly used. Such a kimchi storage device is small in size. Accordingly, while a general refrigerator has a door at its front side, the kimchi storage device has a hinge type door on its top surface.

The kimchi storage device includes a cooling device and a heating device inside. Accordingly, when ripening kimchi, a temperature of the inside of a container is raised by making the heater as a heating device operate, thereby ripening kimchi kept in a containing room. After ripening kimchi properly, the heater is turned off and simultaneously a cooling device is operated, so the temperature of the containing room is properly maintained, and is thereby capable of maintaining the taste and freshness of kimchi for the long term.

Recently, a drawer type kimchi storage device including a drawer in its main body has been suggested. The upper opening and closing type kimchi storage device has a kimchi storage room positioned vertically and the door mounted on the kimchi storage room is to be opened upwardly, and the drawer type kimchi storage device has a drawer consisting of a kimchi storage room positioned horizontally. Recently the compound type kimchi storage device with an upper door of the opening and closing type kimchi storage device and a drawer of the drawer type kimchi storage device has been developed and is in use.

FIG. 1 is a perspective view showing an outer appearance of a general compound-type kimchi storage device, FIG. 2 is a sectional view showing a configuration of the general compound-type kimchi storage device, and FIG. 3 is a sectional view showing a vegetable storage chamber of the general compound-type vegetable storage device.

As shown in the figures, the conventional compound-type kimchi storage device includes a body 1 in which a kimchi storage vessel is included in a kimchi storage cavity 8 and is insulated by an insulating material, a manipulating panel 5 is attached to a front side thereof and an evaporating pipe and a heater are installed to cool and mature stored kimchi; an upper door 2 operated by a hinge 4 for covering the body 1 of the kimchi storage device; and a drawer 6 which is opened and closed by using a handle 7 formed at a front side of the body 1 for storing fresh vegetables 11.

And, the body 1 has an outer case 15 for accommodating insulating material 10 filled therein and an inner case 16 for accommodating the drawer 6.

An evaporating pipe 13 for cooling is installed on a ceiling of the inner case 16 for storing vegetables. The evaporating pipe 13 is used for generating cool air so that the vegetables or fruits are kept fresh in the drawer 6 installed in the inner case 16. The evaporating pipe 13 is isolated by an isolating plate 14 of the inner case 16.

A guide rail member 20 is at one side screwed to guide grooves 21 formed at both sides of the inner case 16 for storing vegetables so that a user may open or close the inner case 16 by pulling and pushing. The other side of the guide rail member 20 is integrated to a rail guide 23 which is screwed to one side of the drawer 6.

The insulating material 10 is contained outside the inner case 16 for vegetable storage I order to insulate the inner case.

There is also provided a machinery room 9 in which a compressor 12 and a condenser used in the cooling cycle are arranged at a rear portion of the inner case 16.

When the insulating material 10 is supplied outside the inner case 16, strong pressure is exerted on the inner case 16 to which-the guide rail member 20 is attached. Thus, there is a problem that the inner case 16 is partially deformed due to the pressure, so the drawer cannot be smoothly opened and closed.

SUMMARY OF THE INVENTION

Therefore, the present invention is designed to solve the problem of the prior art, and an object of the present invention is to provide a combination structure of a guide rail member for a kimchi storage device which includes guide grooves for guiding guide rail members formed at both lower sides of a drawer-type inner case for storage of vegetables, a hooking protrusion elongated from one side of the guide groove, and a fixing member for screwing an upper end of the hooking protrusion in order to maintain a certain space between a lower end of the fixing member and the guide groove, in which one side of a lower end of the fixing member is integrated to one side of the guide rail member so that the inner case integrated to the guide rail member may be smoothly opened and closed though the inner case is partially deformed due to the pressure of insulating materials put outside the inner case.

In one aspect of the present invention, there is provided a combination structure of a guide rail member for a kimchi storage device, which includes guide grooves formed at both sides of a lower end of the inner case, a hook protrusion elongated from the guide groove, and a fixing member, one end of which is screwed to the hook protrusion and the other end of which is fixed to maintain a predetermined space between the fix member and the guide groove, wherein one side of the guide rail member is combined to one side of the lower end of the fixing member. Preferably, the lower end of the fixing member is bent toward the inside of the guide groove.

In addition, the space between the lower end of the fixing member and the guide groove is preferably maintained at as much as 1 mm.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Figure 1:
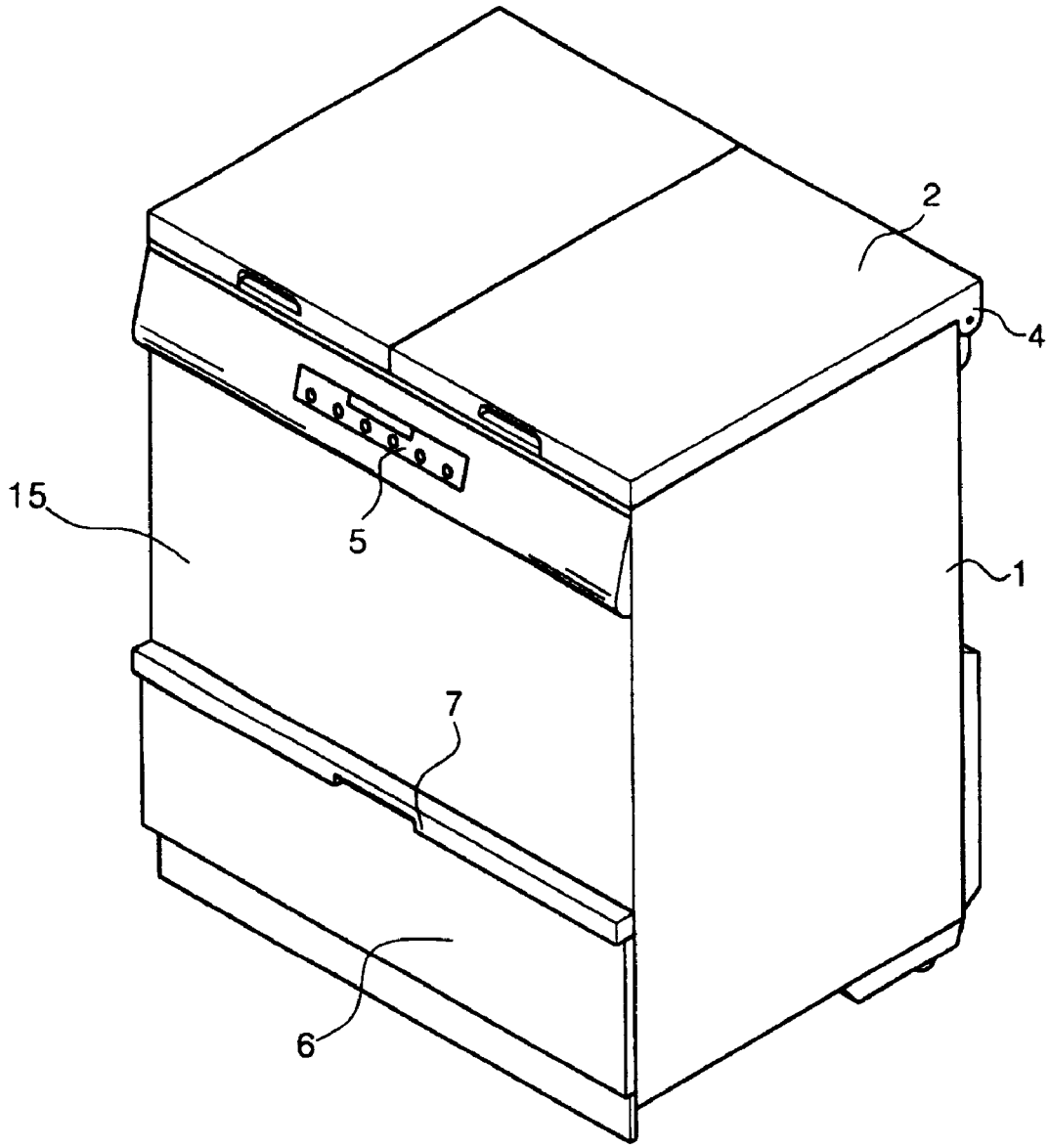
FIG. 1 (PRIOR ART)
FIG. 1 is a perspective view showing outer appearance of a conventional compound-type kimchi storage device.

Hereinafter, a preferred embodiment of the present invention will be described in more detail by referring to the drawings. The embodiment is not intended to limit the scope of the invention but is proposed only as an example. And, the kimchi storage device has the same configuration as the conventional one described with reference to FIG. 1, and is described here in brief.

Figure 2:
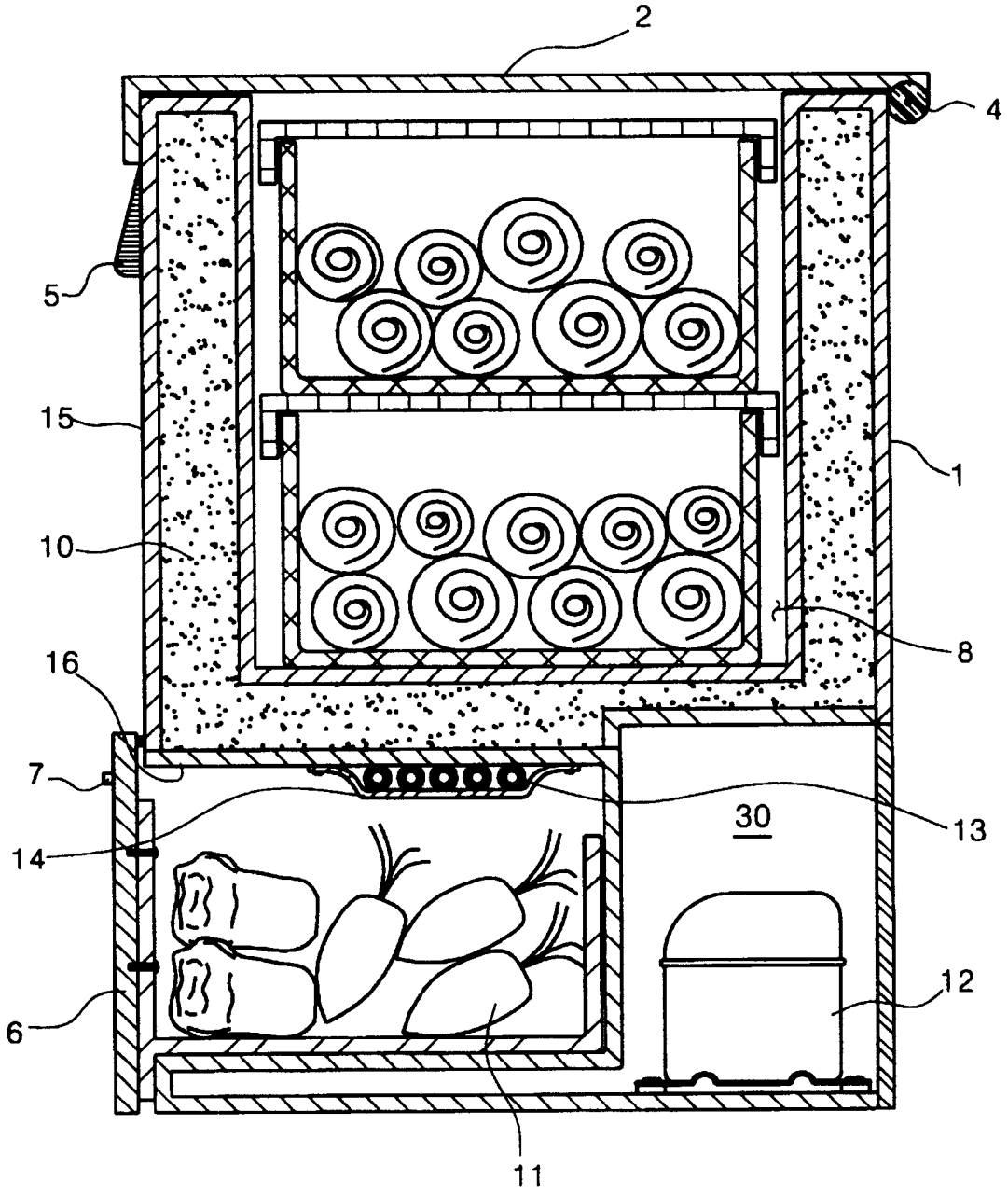
FIG. 2 (PRIOR ART)
FIG. 2 is a sectional view showing the conventional compound-type kimchi storage device.
Figure 3:
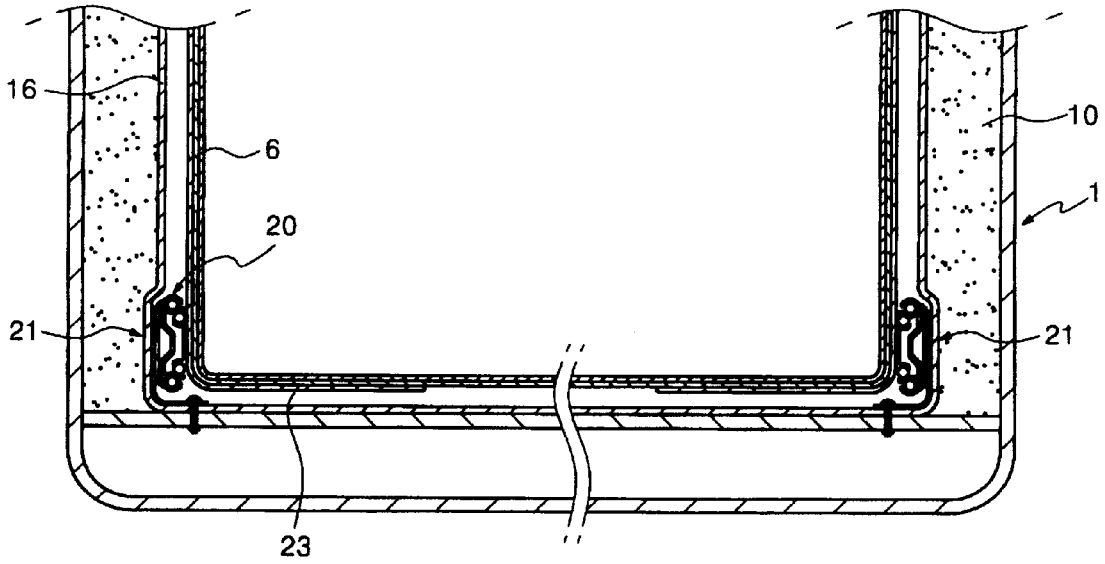
FIG. 3 (PRIOR ART)
FIG. 3 is a sectional view showing a vegetable storage chamber of the conventional compound-type kimchi storage device.

As shown in FIGS. 1 and 2, the kimchi storage device includes a body 1 in which a kimchi storage vessel is included in a kimchi storage cavity 8 and insulated by an insulating material, a manipulating panel 5 is attached to a front side thereof and an evaporating pipe and a heater are installed to cool and mature stored kimchi; an upper door 2 operated by a hinge 4 for covering the body 1 of the kimchi storage device; and a drawer 6 opened and closed by using a handle 7 formed at a front side of the body 1 for storing fresh vegetables 11.

And, the body 1 has an outer case 15 for containing insulating material 10 supplied therein and an inner case 16 for keeping the drawer 6.

An evaporating pipe 13 for cooling is installed on a ceiling of the inner case 16 for storing vegetables. The evaporating pipe 13 is used for generating cool air so that the vegetables or fruits are kept fresh in the drawer 6 installed in the inner case 16. The evaporating pipe 13 is isolated by an isolating plate 14 of the inner case 16.

There is also provided a machinery room 9 in which a compressor 12 and a condenser used in the cooling cycle is arranged at a rear side of the inner case 16.

The insulating material 10 is filled outside the inner case 16 for vegetable storage in order to insulate the inner case.

Figure 4:
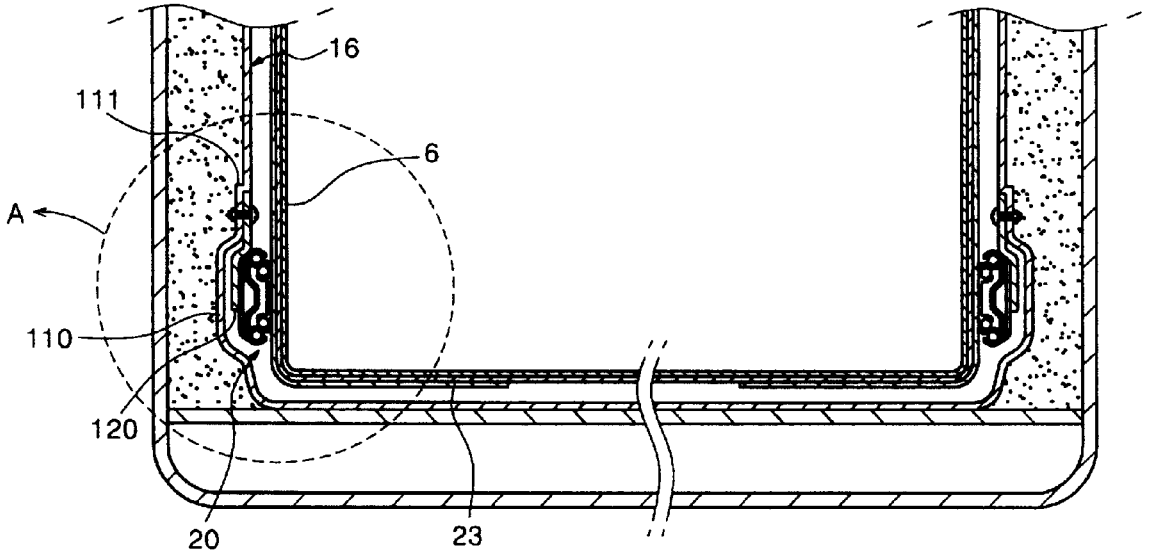
FIG. 4 is a sectional view partially showing a vegetable chamber of a kimchi storage device according to the present invention.
Figure 5:
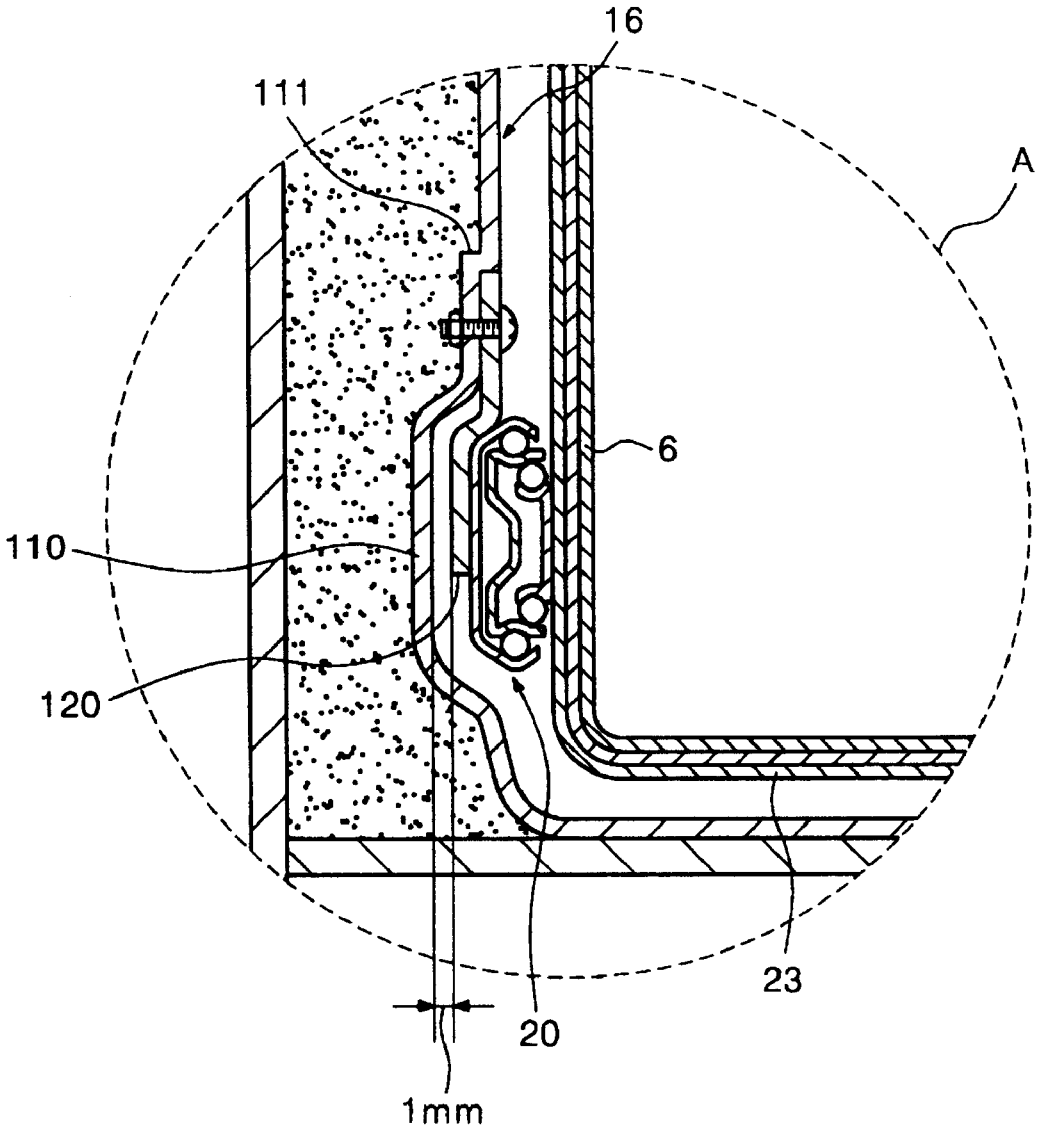
FIG. 5 is an enlarged view showing A portion of FIG. 4.

As shown in FIG. 4, guide grooves 10 are formed at both side of a lower end of the inner case 16 so that the drawer 6 can be pushed and pulled along the guide grooves 10. There is also provided a hook protrusion 111 elongated from one side of the guide groove 110.

A fixing member 120 is at an upper end screwed to the hook protrusion 111. The other end of the fixing member 120 is bent toward the inside of the guide groove 110.

At one side of the lower end of the fixing member 120, one side of a guide rail member 20 is integrally combined. The fixing member 120 is configured so that the lower end of the fixing member 120 and the guide groove 110 maintain a predetermined space therebetween. The other side of the guide rail member 20 is integrally combined to a rail guide 23 which is screwed to one side of the drawer 6.

Preferably, the space between the lower end of the fixing member 120 and the guide groove 110 are configured to maintain a space of as much as 1 mm.

An upper end of the fixing member 120 is screwed to the hook protrusion 111 elongated from one side of the guide groove 110. The lower end of the fixing member 120 and the guide groove 110 are fixed to maintain a predetermined space therebetween, and one side of the guide rail member 20 is integrated to a bottom surface of the fixing member 120. The other side of the guide rail member 20 is integrated to the rail guide 23 screwed to one side of the drawer 6. Thus, even though the inner case 16 is partially deformed due to pressure generated when the insulating material 10 is supplied outside the inner case 16, the drawer 6 can be smoothly opened and closed.

Therefore, a guide rail member for a kimchi storage device of the present invention includes guide grooves for guiding guide rail members formed at both lower sides of a drawertype inner case for storage of vegetables, a hooking protrusion elongated from one side of the guide groove, and a fixing member for screwing an upper end of the hooking protrusion in order to maintain a certain space between a lower end of the hooking protrusion and the guide groove, in which one side of a lower end of the fixing member is integrated to one side of the guide rail member, thus the present invention provides an advantage in that the inner case integrated to the guide rail member may be smoothly opened and closed even though the inner case is partially deformed due to the pressure of insulating materials supplied outside the inner case.

What is claimed is:

1. Combination structure of a guide rail member for a kimchi storage device including a body for cooling or maturing kimchi, an upper door operated by a hinge to cover the body, a drawer horizontally opened or closed by a handle formed at a front side of the body and an inner case for containing the drawer, comprising:

guide grooves formed at both sides of a lower end of the inner case;

a hook protrusion elongated from the guide groove; and a fixing member, one end of which is screwed to the hook protrusion and the other end of which is fixed thereby maintaining a predetermined space between a-lower end of the fixing member and the guide groove, wherein one side of the guide rail member is combined to one side of the lower end of the fixing member.

2. The combination structure according to claim 1, wherein the lower end of the fixing member is bent toward an inside of the guide groove.

3. The combination structure according to claim 1, wherein the predetermined space between the lower end of the fixing member and the guide groove is maintained at as much as 1 mm.

* * * * *